US007369018B2

(12) United States Patent
Shinabe

(10) Patent No.: US 7,369,018 B2
(45) Date of Patent: May 6, 2008

(54) DIELECTRIC FILTER

(75) Inventor: Munehiro Shinabe, Niihama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 258 days.

(21) Appl. No.: 11/196,424

(22) Filed: Aug. 4, 2005

(65) Prior Publication Data

US 2006/0038638 A1 Feb. 23, 2006

(30) Foreign Application Priority Data

Aug. 19, 2004 (JP) ..... 2004-239257

(51) Int. Cl.
*H01P 1/203* (2006.01)

(52) U.S. Cl. ..... 333/204; 333/219

(58) Field of Classification Search ..... 333/175, 333/203–205, 219

See application file for complete search history.

(56) References Cited

U.S. PATENT DOCUMENTS 5,374,909 A * 12/1994 Hirai et al. ..... 333/204
6,020,799 A * 2/2000 Ishizaki et al. ..... 333/204
6,177,853 B1 * 1/2001 Nagatomi et al. ..... 333/204
6,326,866 B1 * 12/2001 Sasaki et al. ..... 333/203
6,492,886 B1 * 12/2002 Kushitani et al. ..... 333/204
2001/0030588 A1 * 10/2001 Son et al. ..... 333/203
2006/0192637 A1 * 8/2006 Urano et al. ..... 333/204

FOREIGN PATENT DOCUMENTS

JP 07142904 6/1995
JP 09018202 A * 1/1997
JP 2004159305 A * 6/2004

* cited by examiner

*Primary Examiner*—Seungsook Ham
(74) *Attorney, Agent, or Firm*—Steptoe & Johnson LLP

(57) ABSTRACT

In order to achieve miniaturization without degrading Q of a dielectric filter in the present invention, resonant elements has upper and lower ground electrodes. The upper ground electrode is formed of upper ground electrodes which correspond to wide portions and have no pattern formed on a portion corresponding to narrow portions, and an upper ground electrode which corresponds to the narrow portions and formed higher than the layer of the upper ground electrodes. The lower ground electrode is formed of lower ground electrodes which correspond to the wide portions and have no pattern formed on a portion corresponding to the narrow portions, and a lower ground electrode which corresponds to the narrow portions and formed lower than the layer of the ground electrodes.

11 Claims, 18 Drawing Sheets

DIELECTRIC FILTER

FIELD OF THE INVENTION

The present invention relates to a dielectric filter used for a high frequency apparatus and the like.

BACKGROUND OF THE INVENTION

A conventional dielectric filter will be described below. FIG. 21 is a plan view showing the conventional dielectric filter. FIG. 22 is a sectional view taken along line A-A of FIG. 21.

The dielectric filter is constituted of first and second resonant elements 2 and 3 each of which is formed in the inner layer of a dielectric substrate 1 and has one open end and the other end connected to the ground, wide portions 2*b* and 3*b* which electromagnetically couple the first and second resonant elements 2 and 3 with each other and are formed on the sides of open ends 2*a* and 3*a*, narrow portions 2*c* and 3*c* formed on the side of a side electrode (a common ground terminal, i.e., the ground) 12 of the first and second resonant elements 2 and 3, bent portions 2*d* and 3*d* bent like letter L from the ends of the wide portions 2*b* and 3*b* to the side electrode 12, first and second input/output electrodes 4*a* and 5*a* formed in the upper layer of the bent portions 2*d* and 3*d*, input/output terminals 4*b* and 5*b* drawn from the input/output electrodes 4*a* and 5*a*, a capacitive electrode 11 formed in the upper layer of the wide portions 2*b* and 3*b*, an upper ground electrode 6 which is formed in the upper layer of the input/output electrodes 4*a* and 5*a* and connected to the side electrode 12, and a lower ground electrode 7 which is formed in the lower layer of the first and second resonant elements 2 and 3 and connected to the side electrode 12.

Ground patterns are formed over the upper ground electrode 6 and the lower ground electrode 7. A distance 8 between the electrode 6 and the wide portions 2*b* and 3*b* and a distance 8 between the electrode 6 and the narrow portions 2*c* and 3*c* are equal to each other. A distance 9 between the lower ground electrode 7 and the wide portions 2*b* and 3*b* and a distance 9 between the lower ground electrode 7 and the narrow portions 2*c* and 3*c* are equal to each other.

The input/output terminals 4*b* and 5*b* are drawn to the layer of the upper ground electrode 6 through inner vias 4*c* and 5*c*. Further, spaces 10*a* and 10*b* are provided between the input/output terminals 4*b* and 5*b* and the end face of the upper ground electrode 6. The spaces 10*a* and 10*b* of 150 μm or larger are necessary to prevent a short circuit on the input/output terminals 4*b* and 5*b* when the upper ground electrode 6 formed with a large pattern spreads during screen printing. The input/output terminals 4*b* and 5*b* are circular when viewed from the top. The input/output terminals 4*b* and 5*b* are about 200 μm in diameter. The dielectric filter protrudes by about 700 μm ((200 μm+150 μm)×2) in the lateral direction of FIG. 22 due to the presence of the input/output terminals 4*b* and 5*b*.

As indicated by dotted lines in FIG. 21, the narrow portions 2*c* and 3*c* of the resonant elements 2 and 3 are arranged in parallel and electromagnetically coupled to each other. Further, the capacitive electrode 11 is electromagnetically coupled to the wide portions 2*b* and 3*b*.

FIG. 23 is a replacement circuit diagram where the pattern of the dielectric filter is replaced with electric elements. In FIG. 23, reference numeral 4*b* denotes the input/output terminal and reference numeral 21 denotes a capacitance formed between the input/output electrode 4*a* and the wide portion 2*b*. Reference numeral 22 denotes an inductance of the narrow portion 2*c* and reference numeral 23 denotes a capacitance formed between the wide portion 2*b* and the ground electrodes 6 and 7. Similarly, reference numeral 24 denotes an inductance of the narrow portion 3*c* and reference numeral 25 denotes a capacitance formed between the wide portion 3*b* and the ground electrodes 6 and 7. Reference numeral 26 denotes a capacitance formed between the input/output electrode 5*a* and the wide portion 3*b* and reference numeral 5*b* denotes the input/output terminal connected to the capacitance 26. Reference numeral 27 denotes a capacitance between the wide portion 2*b* and the capacitive electrode 11 and reference numeral 28 denotes a capacitance between the wide portion 3*b* and the capacitive electrode 11. The inductances 22 and 24 are electromagnetically coupled to each other. Since the wide portions 2*b* and 3*b* are wide and short, the inductances thereof are negligible.

FIG. 24 is an equivalent circuit diagram of the replacement circuit diagram shown in FIG. 23. In FIG. 24, reference numeral 29 denotes a combined capacitance of the capacitance 27 and the capacitance 28 and reference numeral 30 denotes an inductance obtained by the electromagnetic coupling of the narrow portions 2*c* and 3*c*. The inductance 30 can be controlled by a distance 13 between the narrow portions 2*c* and 3*c*. In FIG. 24, the inductance 22 and the capacitance 23 are connected in parallel to form a parallel connection body 32. The parallel connection body 32 has one end connected to the input/output terminal 4*b* via the capacitance 21 and the other end connected to the ground.

Similarly, the inductance 24 and the capacitance 25 are connected in parallel to form a parallel connection body 33. The parallel connection body 33 has one end connected to the input/output terminal 5*b* via the capacitance 26 and the other end connected to the ground. A parallel connection body of the capacitance 29 and the inductance 30 is connected between one end of the parallel connection body 32 and one end of the parallel connection body 33, so that the parallel connection bodies entirely form a band-pass filter.

FIG. 25 is a signal pass characteristic diagram of the dielectric filter. A horizontal axis 34 represents a frequency, a vertical axis 35 represents an attenuation, and arrows represent directions that increase an attenuation. The pass band of the dielectric filter has a center frequency 36 proportionate to a factor of the square root of the product of the inductance 22 (or 24) and the capacitance 23 (or 25). According to the magnitude of the inductance 30 obtained by the electromagnetic coupling of the inductance 22 and the inductance 24, a narrow-band characteristic 37 or a wide-band characteristic 38 can be selected.

To be specific, the narrow-band characteristic 37 is obtained by increasing the distance 13 between the narrow portions 2*c* and 3*c* to have loose coupling or increasing the inductance 22 (or 24), and the wide-band characteristic 38 is obtained by reducing the distance 13 between the narrow portions 2*c* and 3*c* to have close coupling or reducing the inductance 22 (or 24). For example, Japanese Patent Laid-Open No. 7-142904 is known as prior art document information relating to the invention of this application.

In such a conventional dielectric filter, the upper ground electrode 6 is integrally formed over the upper layer of the input/output electrodes 4*a* and 5*a*, and the lower ground electrode 7 is integrally formed over the lower layer of the first and second resonant elements 2 and 3. That is, a distance 8 between the upper ground electrode 6 and the wide portions 2*b* and 3*b* and a distance 8 between the upper ground electrode 6 and the narrow portions 2*c* and 3*c* are equal to each other. The distance 9 between the lower ground electrode 7 and the wide portions 2*b* and 3*b* and the distance 9 between the lower ground electrode 7 and the narrow portions 2*c* and 3*c* are equal to each other.

When the areas of the wide portions 2*b* and 3*b* are reduced without changing the value of the capacitance 23 (or 25) to reduce the dielectric filter, it is necessary to reduce the distance 8 between the upper ground electrode 6 and the wide portions 2*b* and 3*b* and the distance 9 between the lower ground electrode 7 and the wide portions 2*b* and 3*b*. However, when the distance 8 between the upper ground electrode 6 and the narrow portions 2*c* and 3*c* or the distance 9 between the lower ground electrode 7 and the narrow portions 2*c* and 3*c* is reduced, Q of the inductance 22 (or 24) decreases, so that the loss of the pass band of the filter constituted of inductors, that is, an insertion loss increases and Q' of frequency selectiveness decreases. Therefore, it is not possible to reduce the distance 8 or the distance 9 of the wide portions 2*b* and 3*b* and the narrow portions 2*c* and 3*c* which are integrally formed. Considering this restriction, it is not possible to reduce the dielectric filter without degrading its characteristics.

Further, since the upper ground electrode 6 has a relatively large pattern and conductive paste spreads during screen printing, it is necessary to make the spaces 10*a* and 10*b* larger than ordinary spaces, thereby increasing the protrusions of the input/output terminals 4*b* and 5*b* and the area of the filter.

DISCLOSURE OF THE INVENTION

The present invention is devised to solve the conventional problem. An object of the present invention is to provide a dielectric filter which prevents Q degradation of an inductor and achieves miniaturization without increasing a filter insertion loss.

In order to solve the problem, a dielectric filter of the present invention formed of a dielectric multilayered substrate, comprising first and second resonant elements each of which is formed in the inner layer of a dielectric substrate and has one open end and the other end connected to the ground, wide portions which electromagnetically couple the first and second resonant elements with each other and are formed on the sides of the open ends, narrow portions formed on the ground sides of the first and second resonant elements, first and second input/output electrodes formed in the upper layer of the wide portions, a plurality of upper ground electrodes which are formed in the upper layer of the first and second input/output electrodes and connected to the ground, and a plurality of lower ground electrodes which are formed in the lower layer of the first and second resonant elements and connected to the ground, wherein the upper ground electrode is formed of first upper ground electrodes which correspond to the wide portions and have no pattern formed on a portion corresponding to the narrow portions and a second upper ground electrode which corresponds to the narrow portions and formed higher than the layer of the first upper ground electrode, and the lower ground electrode is formed of first lower ground electrodes which correspond to the wide portions and have no pattern formed on a portion corresponding to the narrow portions and a second lower ground electrode which corresponds to the narrow portions and formed lower than the layer of the first lower ground electrode.

A dielectric filter formed of a multilayer substrate, comprising first and second resonant elements each of which is formed in the inner layer of a dielectric substrate and has one open end and the other end connected to the ground, wide portions which electromagnetically couple the first and second resonant element and are formed on the sides of the open ends, narrow portions formed on the ground sides of the first and second resonant elements, first and second input/output electrodes formed in an upper layer of the wide portions, an upper ground electrode which is formed in the upper layer of the first and second input/output electrodes and connected to the ground, and a lower ground electrode which is formed in the lower layer of the first and second resonant elements and connected to the ground, wherein the dielectric filter further comprises a plurality of holes provided at almost regular intervals between the upper ground electrode and lower ground electrode corresponding to the wide portions, the holes being filled with a dielectric having a higher permittivity than the dielectric substrate, and a plurality of holes provided at almost regular intervals between the upper ground electrode and lower ground electrode corresponding the narrow portions, the holes being filled with a dielectric having a lower permittivity than the dielectric substrate.

A dielectric filter, comprising a ground electrode provided over a first layer of a dielectric substrate, a resonator electrode which is provided in a second layer of the dielectric substrate and formed of a pattern, and input/output electrodes which are provided in a third layer of the dielectric substrate and is formed of a pattern, wherein the resonator electrode formed in the second layer is formed of first and second resonant elements, each having one open end and the other end connected to the ground, the open ends of the first and second resonant elements are opposed to the input/output electrodes, and the first and second resonant elements have an electromagnetic field influence portion where magnetic field influence is caused by currents passing through the first and second resonant elements and an electromagnetic field non-influence portion where magnetic field influence is not caused by currents passing through the first and second resonant elements.

As described above, according to the present invention, the upper ground electrode of the dielectric filter is formed of the first upper ground electrodes which correspond to the wide portions and have no pattern formed on a portion corresponding to the narrow portions and the second upper ground electrode which corresponds to the narrow portions and formed higher than the layer of the first upper ground electrode, and the lower ground electrode is formed of the first lower ground electrodes which correspond to the wide portions and have no pattern formed on a portion corresponding to the narrow portions and the second lower ground electrode which corresponds to the narrow portions and formed lower than the layer of the first lower ground electrode. The first upper ground electrodes are provided in the upper layer of the wide portions via the first and second resonant elements and the first lower ground electrodes are provided directly below the wide portions, so that a distance between the wide portions and the first upper and lower ground electrodes is reduced.

Therefore, it is possible to obtain a necessary capacitance without increasing the sizes of the wide portions, thereby miniaturizing the dielectric filter.

At this point, no pattern is formed on the first upper and lower ground electrodes facing the narrow portions. However, outside the first upper and lower ground electrodes, the second upper and lower ground electrodes are formed so as to face the narrow portions.

Therefore, distances between the narrow portions and the second upper and lower ground electrodes are increased and the Q of the inductance is not degraded.

The ground electrode is divided into the first and second ground electrodes, so that each pattern area is reduced and other signal electrodes can be arranged at narrow intervals, thereby miniaturizing an overall module including the filter.

According to the present invention, the first and second resonant elements have the electromagnetic field influence portion where magnetic field influence is caused by currents passing through the first and second resonant elements and the electromagnetic field non-influence portion where magnetic field influence is not caused by currents passing through the first and second resonant elements. Thus, by changing a ratio of the electromagnetic field influence portion to the electromagnetic field non-influence portion, a degree of electromagnetic coupling can be varied without changing an inductance value.

That is, the first and second resonant elements can have loose coupling without changing an inductance value determining the characteristic of the filter, and thus the first and second resonant elements can be brought close to each other and the dielectric filter can be miniaturized.

Further, with the electromagnetic field influence portion and the electromagnetic field non-influence portion, it is possible to control the waveform of a signal pass characteristic by changing a ratio of the electromagnetic field influence portion to the electromagnetic field non-influence portion, thereby designing the filter more flexibly.

Even when the wide portions are reduced, a ratio to an inductance formed in the narrow portion is not changed and a pass bandwidth is not changed because of small distances between the wide portions and the upper and lower ground electrodes.

DESCRIPTION OF THE EMBODIMENTS

Referring to the accompanying drawings, the following will describe preferred embodiments for implementing the present invention.

Embodiment 1

Figure 1:
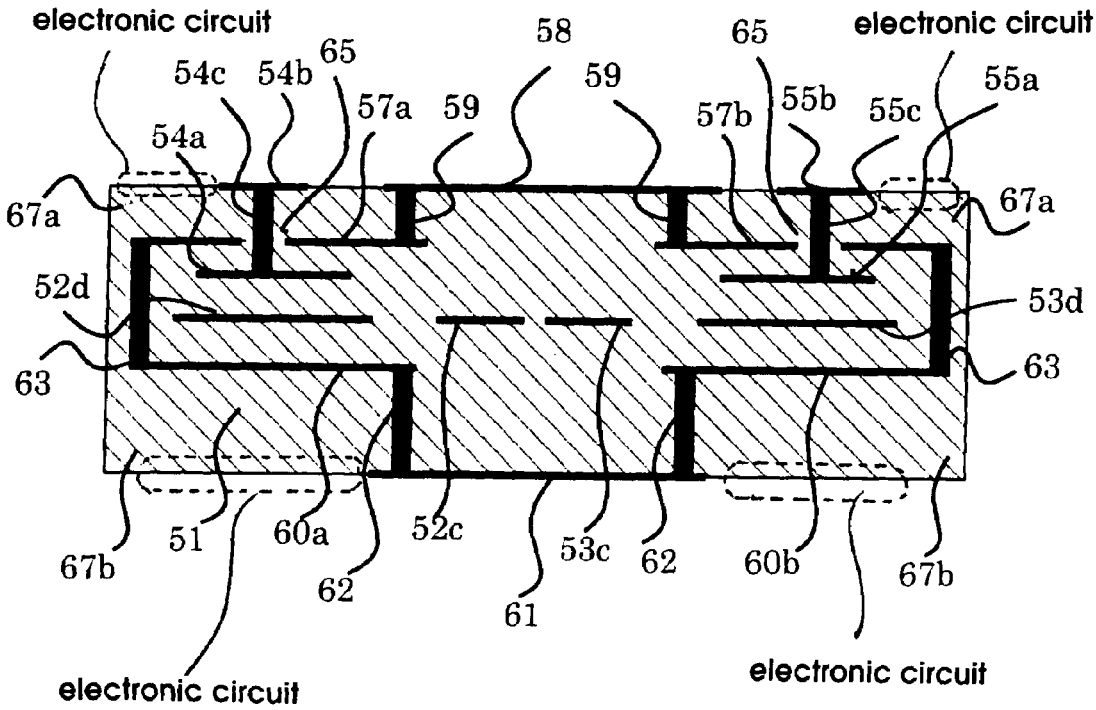
FIG. 1 is a sectional view showing a dielectric filter according to Embodiment 1 of the present invention.
Figure 2:
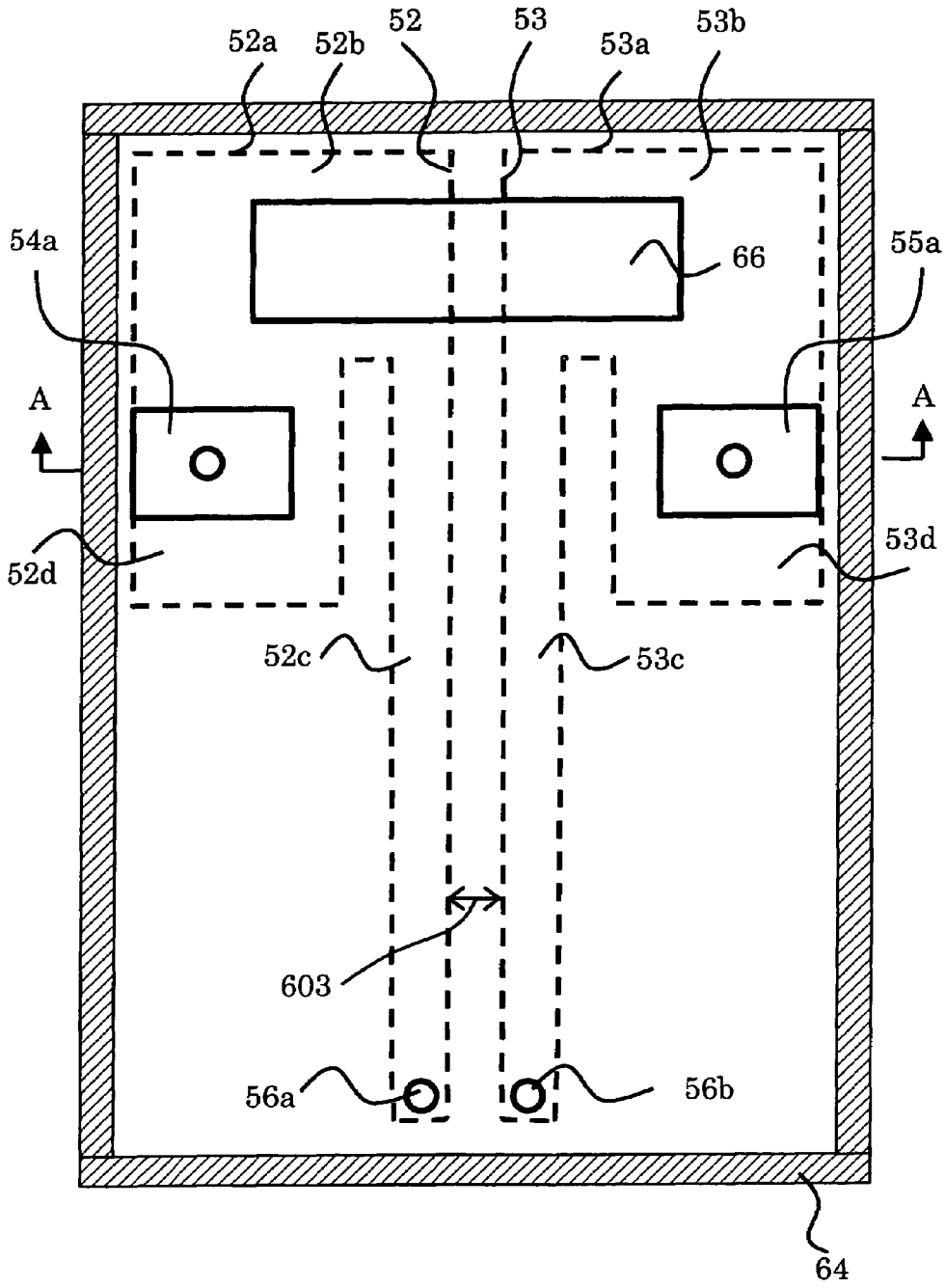
FIG. 2 is a perspective plan view of the dielectric filter.

As shown in FIGS. 1 and 2, a dielectric filter of Embodiment 1 is constituted of first and second resonant elements 52 and 53 each of which is formed in the inner layer of a dielectric substrate 51 and has one open end and the other end connected to the ground via inner vias 56*a* and 56*b*, wide portions 52*b* and 53*b* which electromagnetically couple the first and second resonant elements 52 and 53 and are formed on the sides of open ends 52*a* and 53*a*, narrow portions 52*c* and 53*c* formed on the side of a side electrode (a common ground terminal, i.e., the ground) 64 of the first and second resonant elements 52 and 53, bent portions 52*d* and 53*d* bent like letter L from the ends of the wide portions 52*b* and 53*b* to the side electrode 64, first and second input/output electrodes 54*a* and 55*a* formed in the upper layer of the bent portions 52*d* and 53*d*, input/output terminals 54*b* and 55*b* drawn from the input/output electrodes 54*a* and 55*a*, a capacitive electrode 66 formed in the upper layer of the wide portions 52*b* and 53*b*, a first upper ground electrode 57 which is formed in the upper layer of the input/output electrodes 54*a* and 55*a* and connected to the side electrode 64 (the upper ground electrode 57 is constituted of upper ground electrodes 57*a* and 57*b*), a second upper ground electrode 58 formed in the upper layer of the first upper ground electrode 57, a first lower ground electrode 60 which is formed in the lower layer of the first and second resonant elements 52 and 53 and connected to the side electrode 64 (the lower ground electrode 60 is constituted of lower ground electrodes 60*a* and 60*b*), and a second lower ground electrode 61 formed in the lower layer of the first lower ground electrode 60.

The detail of the constituent elements will be discussed below. The wide portions 52*b* and 53*b* and the bent portions 52*d* and 53*d* are short and wide, and thus hardly contribute to inductance but only contribute to a capacitance. The first upper ground electrodes 57*a* and 57*b* are disposed above the input/output electrodes 54*a* and 55*a* and the capacitive electrode 66 but are not disposed above the narrow portions 52*c* and 53*c*. That is, the first upper ground electrodes 57*a* and 57*b* are not formed above the narrow portions 52*c* and 53*c*. The second upper ground electrode 58 provided in the upper layer of the first upper ground electrode 57 is formed only above the narrow portions 52*c* and 53*c*. The second upper ground electrode 58 and the first upper ground electrode 57 are connected to each other via inner vias 59.

Similarly, the first lower ground electrode 60 is disposed below the wide portions 52*b* and 53*b* and the bent portions 52*d* and 53*d* but is not disposed below the narrow portions 52*c* and 53*c*. That is, the first lower ground electrode 60 is not formed below the narrow portions 52*c* and 53*c*. The second lower ground electrode 61 disposed in the lower layer of the first lower ground electrode 60 is formed only below the narrow portions 52*c* and 53*c*. The second lower ground electrode 61 and the first lower ground electrode 60 are connected to each other via inner vias 62. The first upper ground electrode 57 and the first lower ground electrode 60 are connected to each other via inner vias 63.

In this way, the first upper ground electrode 57 is disposed in the upper layer of the wide portions 52*b* an 53*b* and the bent portions 52*d* and 53*d* via the input/output electrodes 54*a* and 55*a*, and the first lower ground electrode 60 is disposed directly below the wide portions 52*b* and 53*b* and the bent portions 52*d* and 53*d*, thereby reducing a distance from the wide portions 52*b* and 53*b* and the bent portions 52*d* and 53*d* to the first upper ground electrode 57. A distance to the first lower ground electrode 60 is also reduced. Since an electric capacitance to the ground can be increased, a necessary capacitance can be obtained without increasing the sizes of the wide portions 52*b* and 53*b* and the bent portions 52*d* and 53*d*, thereby reducing the size of the dielectric filter. At this point, no pattern is formed on the first upper and lower ground electrodes 57 and 60 facing the narrow portions 52*c* and 53*c*. However, outside the upper and lower ground electrodes 57 and 60, the second upper and lower ground electrodes 58 and 61 are formed so as to face the narrow portions 52*c* and 53*c*. Therefore, distances between the narrow portions 52*c* and 53*c* and the second upper and lower ground electrodes 58 and 61 are increased and the Q of the inductance is not degraded.

Even when the wide portions 52*b* and 53*b* are reduced in size, an electric capacitance does not change because the distances between the wide portions 52*b* and 53*b* and the upper and lower ground electrodes 57 and 60 are reduced. No change is made to a ratio of an inductance formed on the narrow portions 52*c* and 53*c* to a capacitance formed between the wide portions 52*b* and 53*b* and the upper and lower ground electrodes 57 and 60, and thus a signal pass characteristic is not changed.

As shown in FIG. 1, the first upper ground electrode 57*a* has a ground non-formation portion 65 corresponding to the input/output electrode 54*a*. An inner via 54*c* penetrates the non-formation portion 65 to connect the input/output electrode 54*a* and an input/output terminal 54*b*. Similarly, the first upper ground electrode 57*b* has a ground non-formation portion 65 corresponding to the input/output electrode 55*a*. An inner via 55*c* penetrates the non-formation portion 65 to connect the input/output electrode 55*a* and the input/output terminal 55*b*. The input/output terminals 54*b* and 55*b* are formed in the layer of the second upper ground electrode 58 disposed higher than the first upper ground electrode 57, and thus the input/output terminals 54*b* and 55*b* do not protrude from the outside shape of the dielectric filter, thereby miniaturizing the dielectric filter. As described above, in the present embodiment, the dielectric filter can be miniaturized by using a vacant space above the first ground electrode 57.

The first upper ground layer 57 is divided into three of the ground electrode 57*a* corresponding to the input/output electrode 54*a*, the ground electrode 57*b* facing the input/output electrode 55*a*, and the second upper ground electrode 58. Similarly, the first lower ground layer 60 is divided into three of the ground electrode 60*a* facing the wide portion 52*b* and the bent portion 52*d*, the ground electrode 60*b* facing the wide portion 53*b* and the bent portion 53*d*, and the second lower ground electrode 61. In this way, the ground electrodes are each divided into three, and thus it is possible to reduce the ground pattern of a layer where the ground electrode is formed.

Further, an upper layer 67*a* of the first upper ground electrode 57 and a lower layer 67*b* of the first lower ground electrode 60 are vacant spaces where other electronic circuits can be disposed. Thus, the dielectric filter can be entirely miniaturized. For example, when the dielectric filter of the present embodiment is embedded as a module in a parent substrate, the vacant spaces are used to mount other circuits, so that the parent substrate can be entirely miniaturized.

Figure 4:
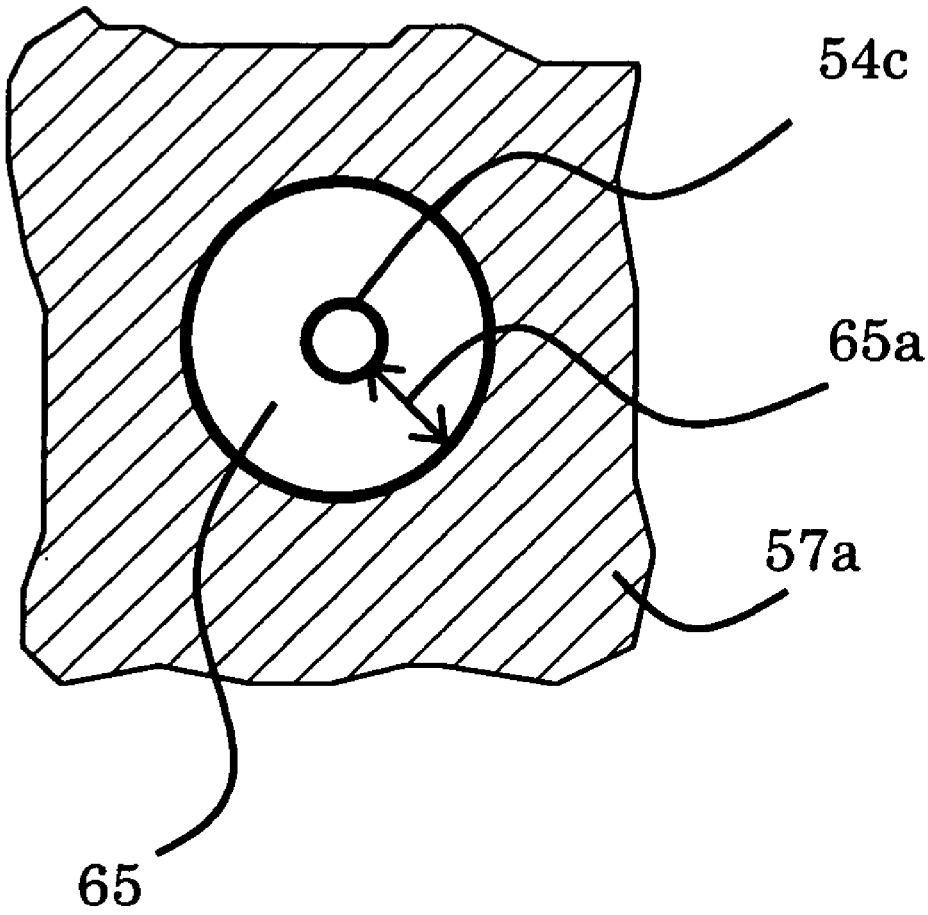
FIG. 4 is a plan view showing the main part of the dielectric filter.

As shown in FIG. 4, between the inner via 54*c* (or 55*c*) which is connected to the input/output terminal 54*b* (or 55*b*) shaped like a circle when viewed from the top and the ground non-formation portion 65 which is formed on the first upper ground electrode 57*a* (or 57*b*), a distance 65*a* is set to 100 μm or larger when the ground pattern is small. This distance is necessary to prevent the pattern of a ground portion 57*a* from spreading during screen printing and prevent a short circuit.

A larger pattern causes the wide spread of the pattern during screen printing. In the present embodiment, the pattern is divided into three, thereby reducing the spread of the pattern. The provision of solder balls on the input/output terminals 54*b* and 55*b* achieves a surface mountable dielectric filter.

As indicated by dotted lines in FIG. 2, the narrow portions 52*c* and 53*c* of the resonant elements 52 and 53 are arranged in parallel and electromagnetically coupled to each other. Further, the capacitive electrode 66 is electromagnetically coupled to the wide portions 52*b* and 53*b*.

Figure 5:
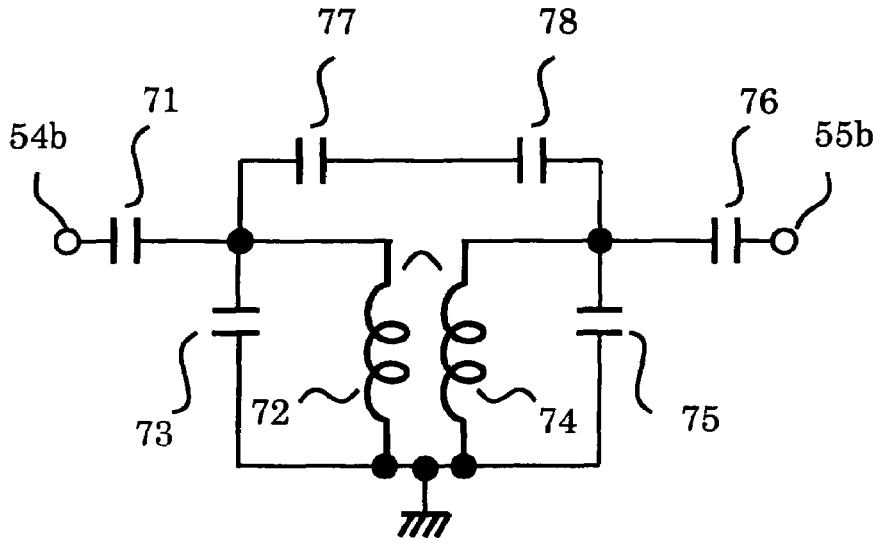
FIG. 5 is a replacement circuit diagram where the pattern of the dielectric filter is replaced with electric elements.

FIG. 5 is a replacement circuit diagram where the pattern of the dielectric filter is replaced with electric elements. In FIG. 5, reference numeral 54*b* denotes the input/output terminal and reference numeral 71 denotes a capacitance formed between the input/output electrode 54*a* and the bent portion 52*d*. Reference numeral 72 denotes an inductance of the narrow portion 52*c* and reference numeral 73 denotes a capacitance formed between the wide portion 52*b* and the bent portion 52*d* and the ground electrodes 57*a* and 60*a*. Similarly, reference numeral 74 denotes an inductance of the narrow portion 53*c* and reference numeral 75 denotes a capacitance formed between the wide portion 53*b* and the bent portion 53*d* and the ground electrodes 57*b* and 60*b*. Reference numeral 76 denotes a capacitance formed between the input/output electrode 55*a* and the bent portion 53*d* and reference numeral 55*b* denotes the input/output terminal connected to the capacitance 76. The inductances 72 and 74 are electromagnetically coupled to each other. Reference numeral 77 denotes a capacitance between the wide portion 52*b* and the capacitive electrode 66 and reference numeral 78 denotes a capacitance between the wide portion 53*b* and the capacitive electrode 66. Since the wide portions 52*b* and 53*b* are wide and short, the inductances thereof are negligible.

Figure 6:
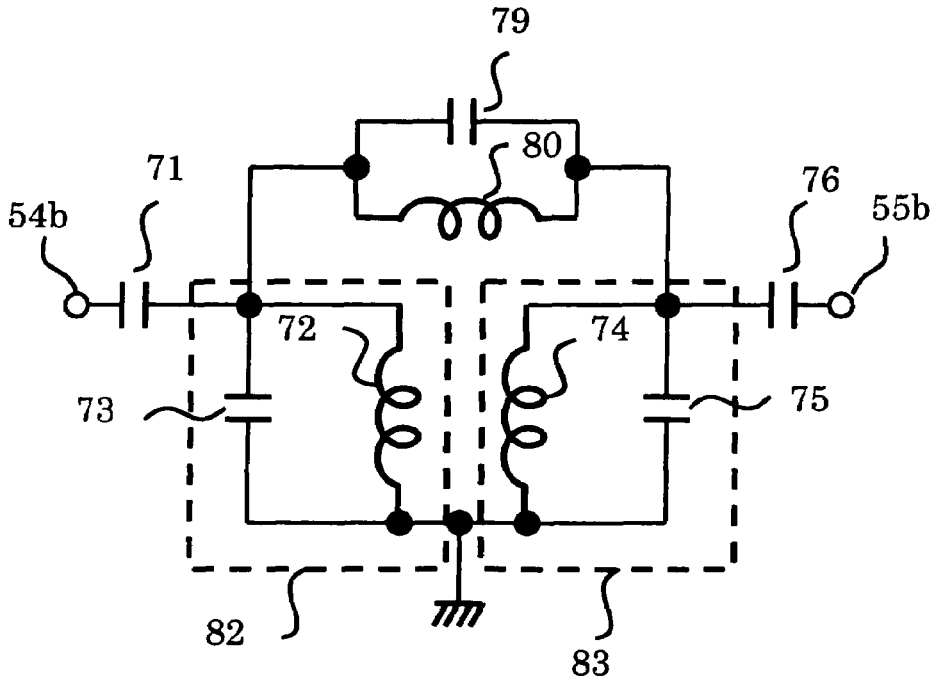
FIG. 6 is an equivalent circuit diagram of the replacement circuit diagram.

FIG. 6 is an equivalent circuit diagram of the replacement circuit diagram shown in FIG. 5. In FIG. 6, reference numeral 79 denotes a combined capacitance of the capacitance 77 and the capacitance 78 and reference numeral 80 denotes an inductance obtained by the electromagnetic coupling of the narrow portions 52*c* and 53*c*. The inductance 80 can be controlled by a distance 603 between the narrow portions 52*c* and 53*c*.

In FIG. 6, the inductance 72 and the capacitance 73 are connected in parallel to form a parallel connection body 82. The parallel connection body 82 has one end connected to the input/output terminal 54*b* via the capacitance 71 and the other end connected to the ground.

Similarly, the inductance 74 and the capacitance 75 are connected in parallel to form a parallel connection body 83. The parallel connection body 83 has one end connected to the input/output terminal 55*b* via the capacitance 76 and the other end connected to the ground.

A parallel connection body of the capacitance 79 and the inductance 80 is connected between the one end of the parallel connection body 82 and the one end of the parallel connection body 83, so that the parallel connection bodies form a band-pass filter.

Figure 7:
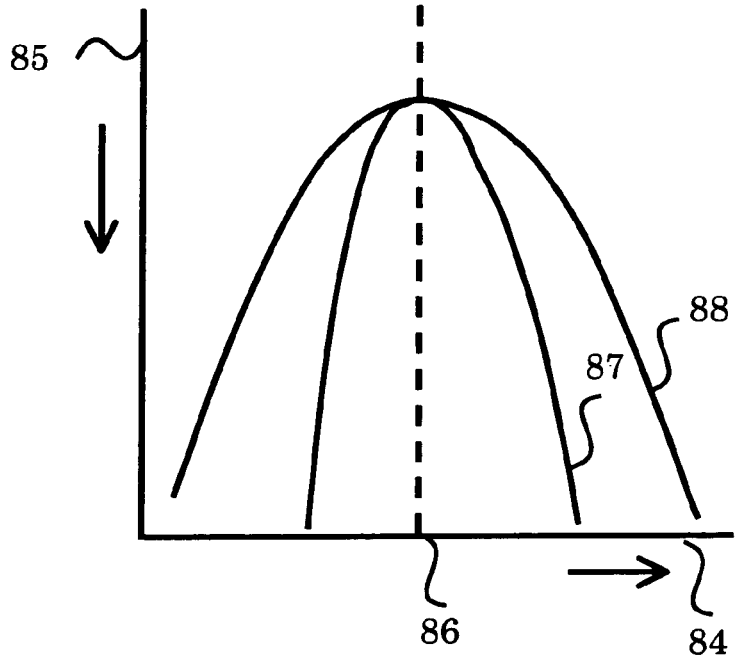
FIG. 7 is a signal pass characteristic diagram of the dielectric filter.

FIG. 7 is a signal pass characteristic diagram of the dielectric filter. A horizontal axis 84 represents a frequency and a vertical axis 85 represents an attenuation in the downward direction. The pass band of the dielectric filter has a center frequency 86 proportionate to a factor of the square root of the product of the inductance 72 (or 74) and the capacitance 73 (or 75). A narrow-band characteristic 87 or a wide-band characteristic 88 is selected according to the magnitude of the inductance 80 obtained by the electromagnetic coupling of the inductance 72 and the inductance 74. In other words, the narrow-band characteristic 87 is obtained by increasing the inductance 72 (or 74) and reducing the capacitance 73 (or 75), or increasing the distance 603 between the narrow portions 52*c* and 53*c* so as to have loose coupling. The wide-band characteristic 88 is obtained by reducing the inductance 72 (or 74) and increasing the capacitance 73 (or 75), or reducing the distance 603 between the narrow portions 52*c* and 53*c* so as to have close coupling.

Figure 3:
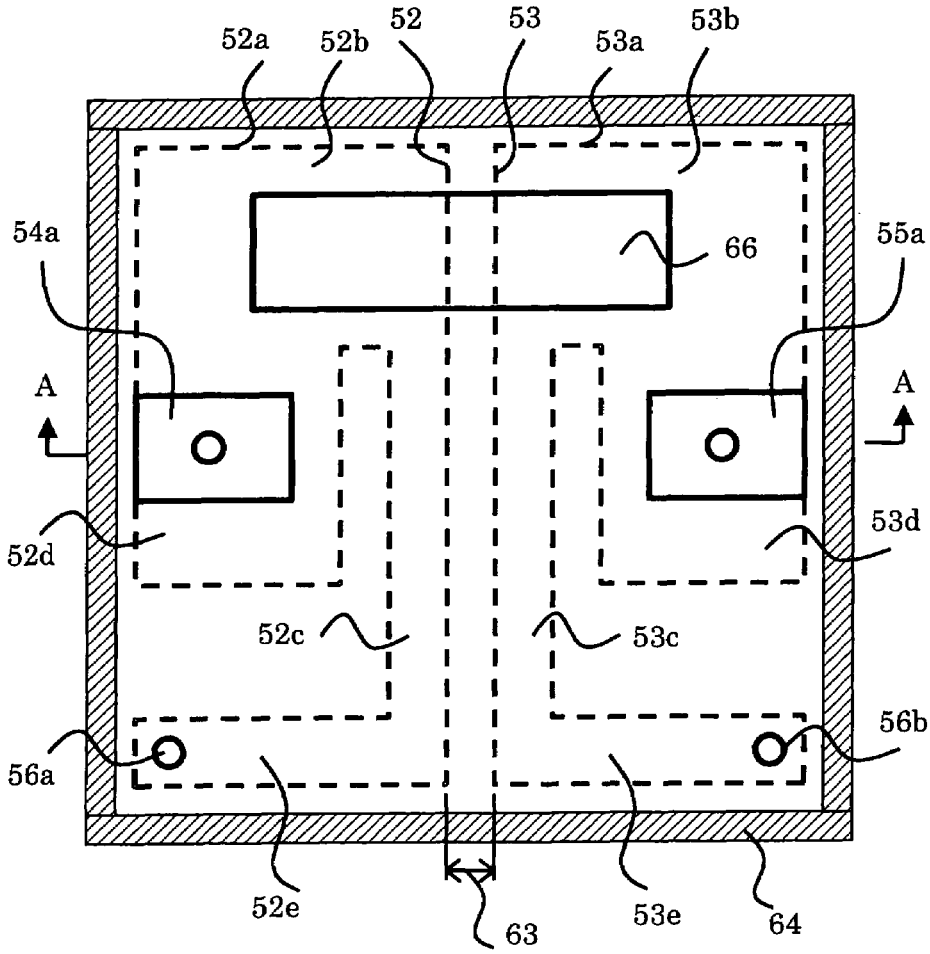
FIG. 3 is another perspective plan view of the dielectric filter.

Referring to FIG. 3, an example of a smaller size will be discussed below in consideration of the above characteristics.

Between a side electrode 64 and wide portions 52*b* and 53*b* of resonant elements 52 and 53, first narrow portions 52*c* and 53*c* and second narrow portions 52*e* and 53*e* are formed. Of these narrow portions, the first narrow portions 52*c* and 53*c* on the side of the wide portions 52*b* and 53*b* are formed in parallel and form an electromagnetic field influence portion where electromagnetic field influence is caused by currents passing through the resonant elements 52 and 53.

The second narrow portions 52*e* and 53*e* which are connected with the first narrow portions 52*c* and 53*c* and provided inside the side electrode 64 are bent at right angles in opposite directions and connected to the side electrode 64. The second narrow portions 52*e* and 53*e* are disposed on a straight line and are not arranged in parallel, and thus the second narrow portions 52*e* and 53*e* form an electromagnetic field non-influence portion where magnetic field influence is not caused by currents passing through the resonant elements 52 and 53.

The resonant elements 52 and 53 are not electromagnetically coupled to each other. That is, the resonant elements 52 and 53 form the electromagnetic field non-influence portion. In this case, the first narrow portions 52*c* and 53*c* are equal in length. Further, the second narrow portions 52*e* and 53*e* are equal in length.

As described above, the electromagnetic field influence portion and the electromagnetic field non-influence portion are obtained using patterns with a simple configuration, thereby achieving an inexpensive dielectric filter. The dielectric filter can be further miniaturized by bending the second narrow portions 52*e* and 53*e* forming the electromagnetic field non-influence portion.

The detail of the operating principles of the electromagnetic field non-influence portion will be described in Embodiment 3. This example is also effective to a configuration where first upper and lower ground electrodes are absent and only second upper and lower ground electrodes are provided over a filter.

Embodiment 2

Figure 8:
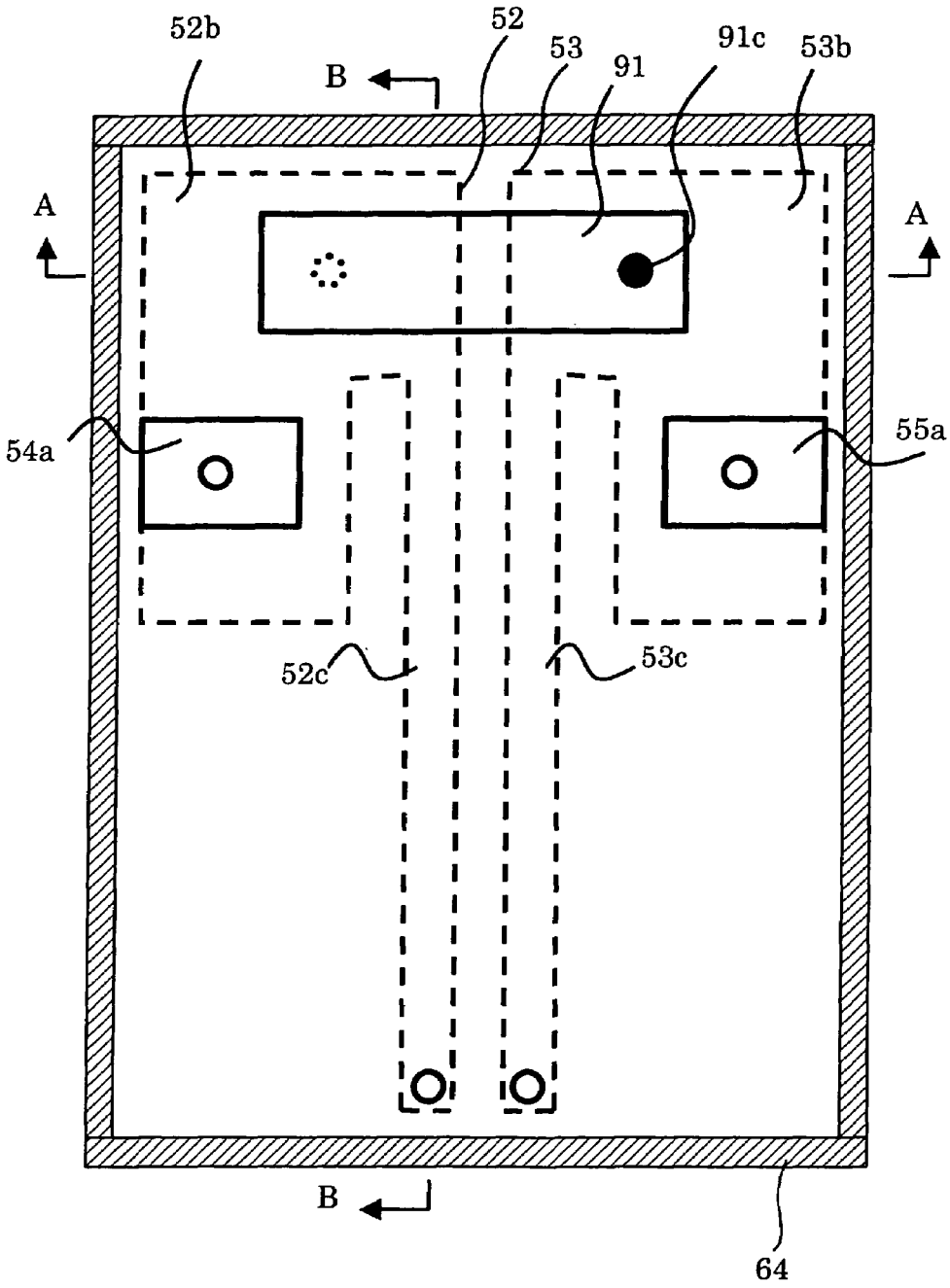
FIG. 8 is a perspective plan view showing a dielectric filter according to Embodiment 2 of the present invention.
Figure 10:
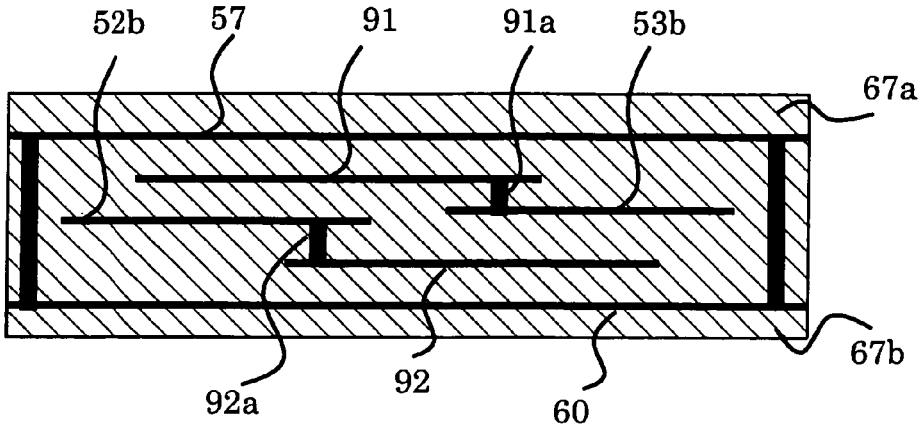
FIG. 10 is a sectional view taken along line A-A of FIG. 9.
Figure 11:
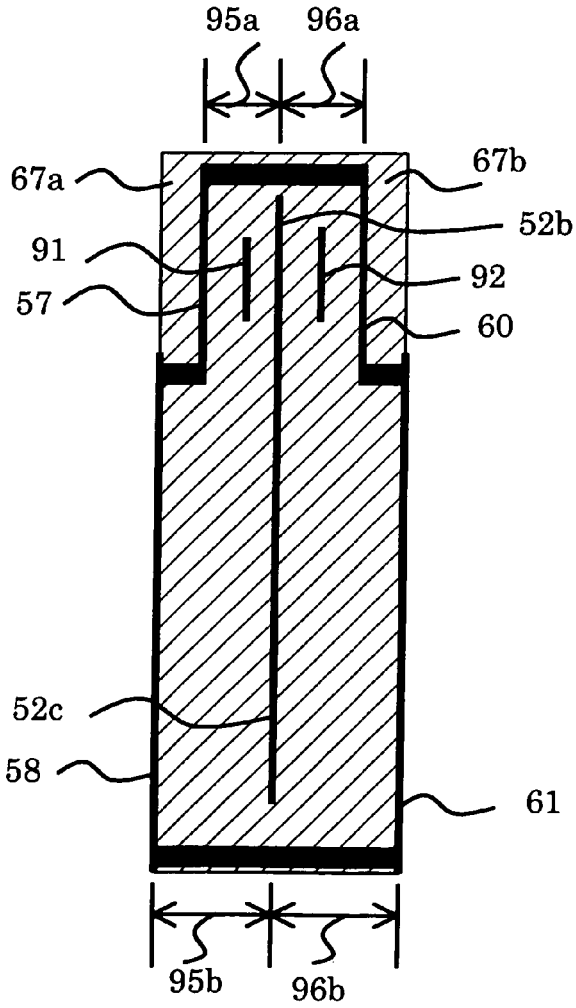
FIG. 11 is a sectional view taken along line B-B of FIG. 9.
Figure 12:
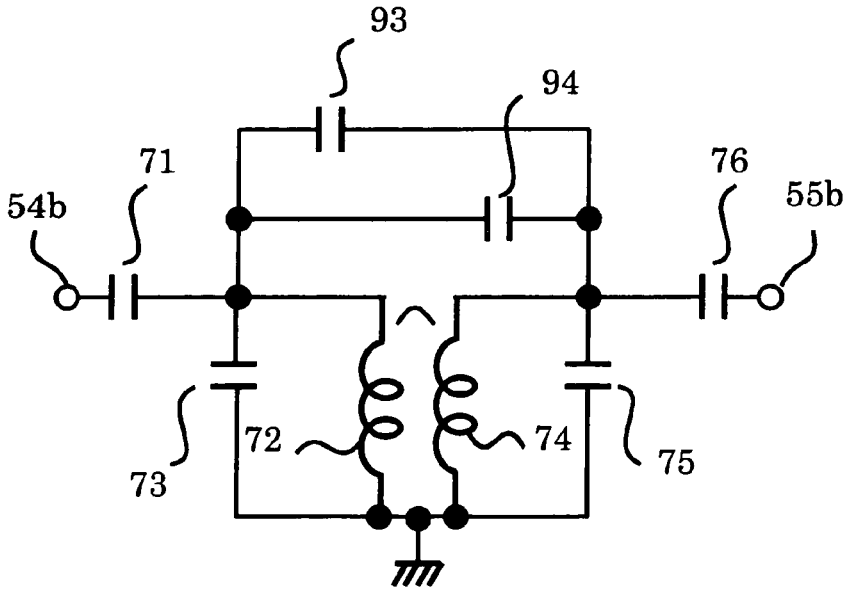
FIG. 12 is a replacement circuit diagram where the pattern of the dielectric filter is replaced with electric elements.

FIG. 8 is a plan view showing a dielectric filter according to Embodiment 2. FIG. 10 is a sectional view taken along line A-A of FIG. 8. FIG. 11 is a sectional view taken along line B-B of FIG. 8. FIG. 12 is an equivalent circuit diagram of FIG. 8. The same constituent elements as Embodiment 1 will be indicated by the same reference numerals and the explanation thereof is simplified.

Embodiment 2 is different from Embodiment 1 in that two capacitive electrodes 91 and 92 are provided and one ends of the electrodes are directly connected to resonant elements 52 and 53 via inner vias 91*a* and 92*a*, respectively. In FIGS. 8, 10, and 11, the capacitive electrode 91 is disposed in the upper layer of a wide portion 53*b* so as to face a wide portion 52*b*. The capacitive electrode 91 is directly connected, on the side of the wide portion 53*b*, to the wide portion 53*b* via the inner via 91*a*. Further, the capacitive electrode 92 is disposed in the lower layer of the wide portion 52*b* so as to face a wide portion 53*b*. The capacitive electrode 92 is directly connected, on the side of the wide portion 52*b*, to the wide portion 52*b* via the inner via 92*a*.

In FIG. 12, reference numeral 93 denotes a capacitance between the wide portion 52*b* and the capacitive electrode 91 and reference numeral 94 denotes a capacitance formed between the wide portion 53*b* and the capacitive electrode 92. In the present embodiment, the capacitances 93 and 94 are connected in parallel, thereby increasing an electric capacitance. Therefore, the capacitive electrodes 91 and 92 can be reduced with the same electric capacitance. Further, the one ends of the capacitive electrodes 91 and 92 are directly connected via the inner vias 91*a* and 92*a* and thus increase coupling, so that miniaturization is achieved. As shown in FIG. 11, an upper layer 67*a* of a first upper ground electrode 57 and a lower layer 67*b* of a first lower ground electrode 60 have vacant spaces where other electronic circuits can be provided.

Also in the present embodiment, a distance 95*b* between a second upper ground electrode 58 and a narrow portion 52*c* (or 53*c*) is larger than a distance 95*a* between the first upper ground electrode 57 and the wide portion 52*b* (or 53*b*). Similarly, a distance 96*b* between a second lower ground electrode 61 and a narrow portion 52*c* (or 53*c*) is larger than a distance 96*a* between a first lower ground electrode 60 and the wide portion 52*b* (or 53*b*). Therefore, as in Embodiment 1, it is possible to increase the electric capacitance of the wide portion 52*b* (or 53*b*) and the grounds 57 and 60 without reducing Q of the narrow portion 52*c* (or 53*c*). That is, the dielectric filter can be miniaturized.

Figure 9:
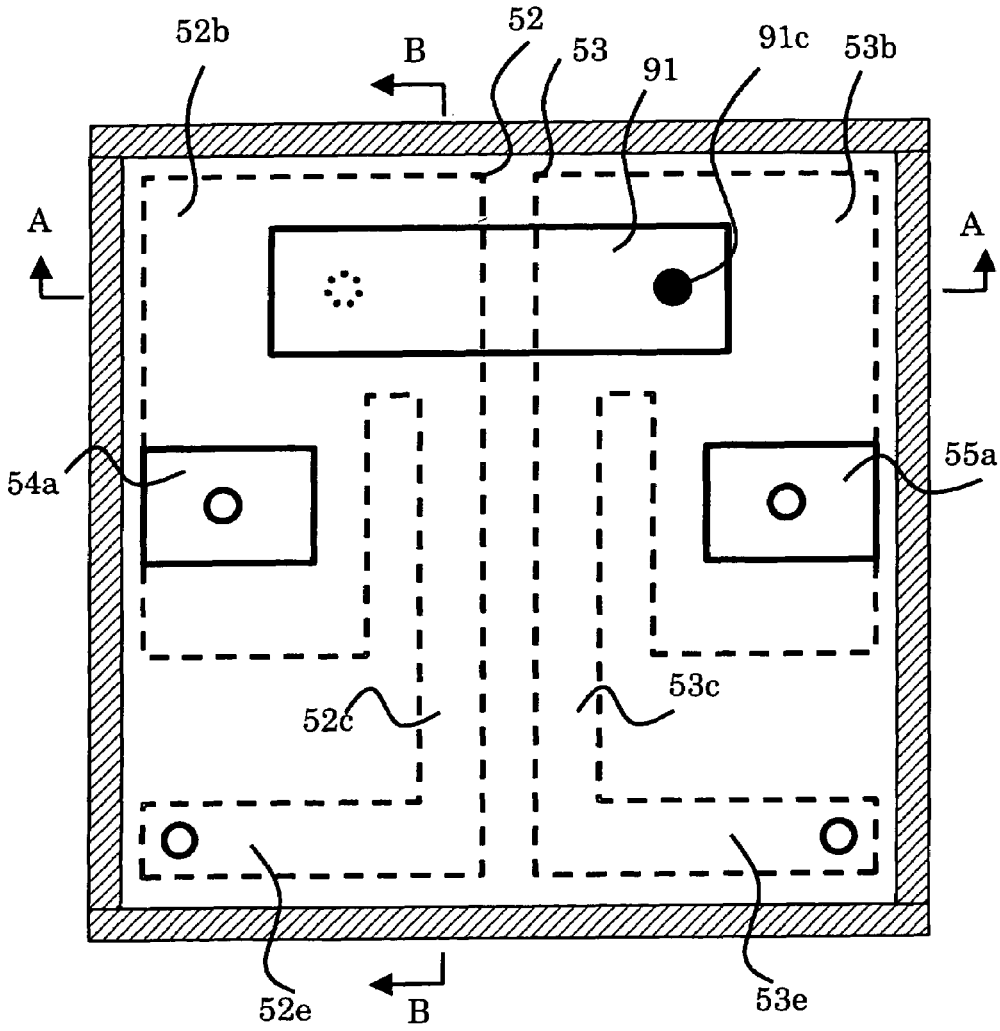
FIG. 9 is another perspective plan view of the dielectric filter.

Referring to FIG. 9, an example of a smaller size with the same principle as Embodiment 1 will be discussed below.

Between a side electrode 64 and wide portions 52*b* and 53*b* of resonant elements 52 and 53, first narrow portions 52*c* and 53*c* and second narrow portions 52*e* and 53*e* are formed. Of these narrow portions, the first narrow portions 52*c* and 53*c* on the side of the wide portions 52*b* and 53*b* are formed in parallel and form an electromagnetic field influence portion where electromagnetic field influence is caused by currents passing through the resonant elements 52 and 53.

The second narrow portions 52*e* and 53*e* which are connected with the first narrow portions 52*c* and 53*c* and provided inside the side electrode 64 are bent at right angles in opposite directions and connected to the side electrode 64. The second narrow portions 52*e* and 53*e* are disposed on a straight line and are not arranged in parallel, and thus the second narrow portions 52*e* and 53*e* form an electromagnetic field non-influence portion where magnetic field influence is not caused by currents passing through the resonant elements 52 and 53.

The resonant elements 52 and 53 are not electromagnetically coupled to each other, that is, the resonant elements 52 and 53 form an electromagnetic field non-influence portion. In this case, the first narrow portions 52*c* and 53*c* are equal in length. The second narrow portions 52*e* and 53*e* are also equal in length.

As described above, the electromagnetic field influence portion and the electromagnetic field non-influence portion are obtained using patterns with a simple configuration, thereby achieving an inexpensive dielectric filter. The dielectric filter can be miniaturized by bending the second narrow portions 52*e* and 53*e* forming the electromagnetic field non-influence portion.

The detail of the operating principles of the electromagnetic field non-influence portion will be described in Embodiment 3.

This example is also effective to a configuration where first upper and lower ground electrodes are absent and only second upper and lower ground electrodes are provided over a filter.

Embodiment 3

Figure 13:
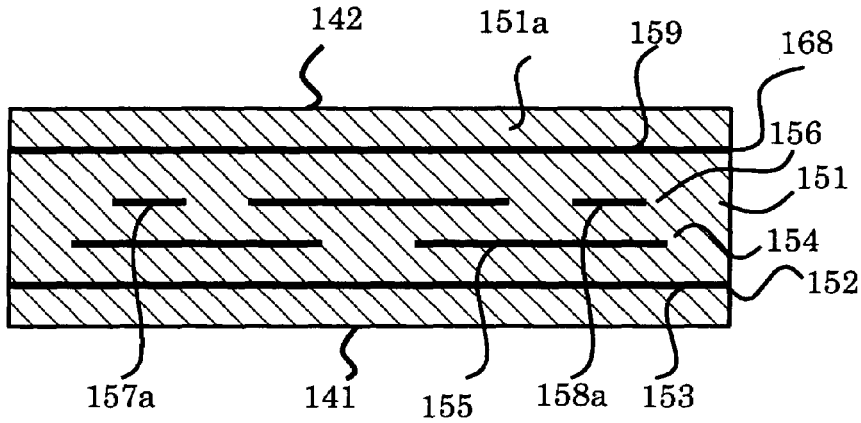
FIG. 13 is a sectional view showing a dielectric filter according to Embodiment 3 of the present invention.
Figure 14:
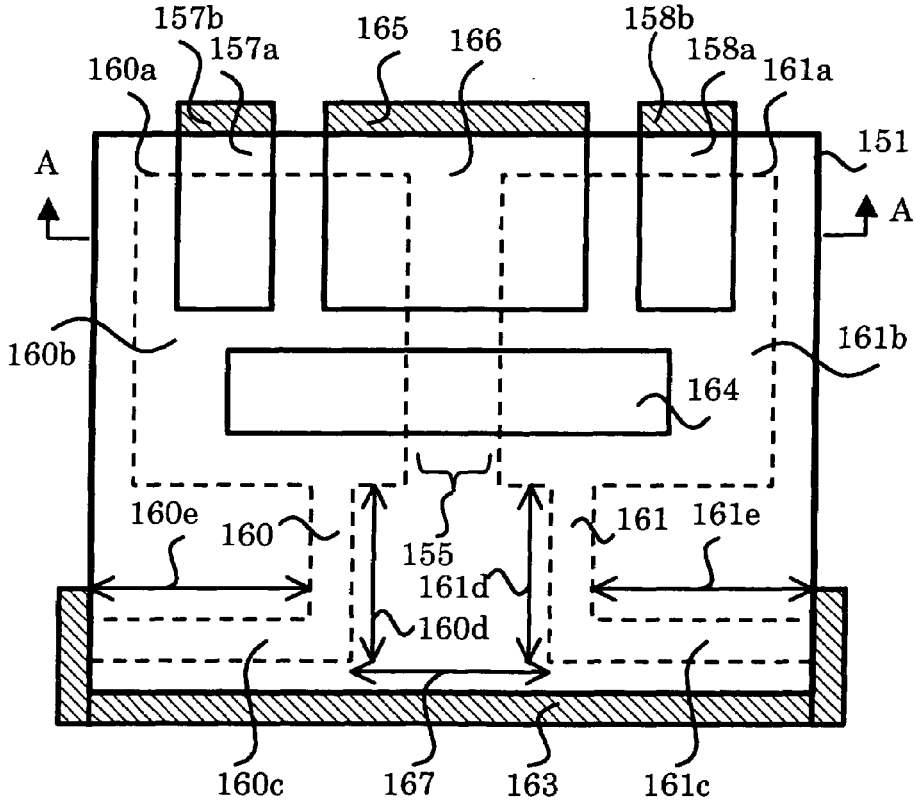
FIG. 14 is a perspective plan view of the dielectric filter.

FIG. 13 is a sectional view showing a dielectric filter according to Embodiment 3. The dielectric filter of Embodiment 3 is different from Embodiments 1 and 2 in that a ground electrode 166 is provided between input/output electrodes 157*a* and 158*a* as shown in FIG. 14. Thus, in the present embodiment, isolation improves between the input/output electrodes 157*a* and 158*a*. Further, in the present embodiment, narrow portions 160*c* and 161*c* are bent and miniaturized.

To be specific, as shown in FIG. 13, the dielectric filter of the present embodiment is constituted of a ground electrode 153 provided in a first layer 152 of a dielectric substrate 151, a resonator electrode 155 which is stacked above the ground electrode 153 and provided in a second layer 154, input/output electrodes 157*a* and 158*a* which are stacked above the resonator electrode 155 and provided in a third layer 156, and a ground electrode 159 which is stacked above the input/output electrodes 157*a* and 158*a* and provided in a fourth layer 168. Moreover, a protection layer 151*a* is provided on the ground electrode 159.

FIG. 14 is a plan view of FIG. 13. As indicated by dotted lines of FIG. 14, the resonator electrode 155 provided in the second layer 154 is formed of a resonant element 160 and a resonant element 161 which are formed of copper or silver patterns. One ends of the resonant elements 160 and 161 form open ends 160*a* and 161*a* and the other ends of the resonant elements 160 and 161 are connected to the ground electrodes 153 and 159 via a side electrode 163.

Wide portions 160*b* and 161*b* are formed on the sides of the open ends 160*a* and 161*a* of the resonant elements 160 and 161. The wide portions 160*b* and 161*b* are opposed to the input/output electrodes 157*a* and 158*a* formed of copper or silver patterns in the third layer 156. The input/output electrodes 157*a* and 158*a* are respectively connected to input/output terminals 157*b* and 158*b* provided on a side of the dielectric filter.

Further, a capacitive electrode 164 is provided which is formed of a copper or silver pattern in the third layer 156 so as to face the wide portions 160*b* and 161*b* and are electromagnetically coupled to the wide portions 160*b* and 161*b*. Moreover, the third layer 156 has a ground electrode 166 which is connected, between the input/output electrodes 157*a* and 158*a*, to the ground electrodes 153 and 159 via a side electrode 165. Therefore, it is possible to improve isolation between the input/output electrodes 157*a* and 158*a*.

Narrow portions 160*c* and 161*c* are formed between the side electrode 163 and the wide portions 160*b* and 161*b* of the resonant elements 160 and 161. In the narrow portions 160*c* and 161*c*, first portions 160*d* and 161*d* on the sides of the wide portions 160*b* and 161*b* are formed in parallel. The resonant elements 160 and 161 are electromagnetically coupled to each other between the first portions 160*d* and 161*d*. That is, an electromagnetic field influence portion is formed. The narrow portions 160*c* and 161*c*, which are connected with the first portions 160*d* and 161*d* and provided inside the side electrode 163, have second portions 160*e* and 161*e* bent at right angles in opposite directions and connected to the side electrode 163. The second portions 160*e* and 161*e* are provided on a straight line and are not arranged in parallel. Thus, the resonant elements 160 and 161 are not electromagnetically coupled to each other on this portion. That is, an electromagnetic field non-influence portion is formed. In this case, the first portions 160*d* and 161*d* are equal in length. The second portions 160*e* and 161*e* are also equal in length. As described above, the electromagnetic field influence portion and the electromagnetic field non-influence portion are obtained using patterns with a simple configuration, thereby achieving an inexpensive dielectric filter. The dielectric filter can be miniaturized by bending the second portions 160*e* and 161*e* forming the electromagnetic field non-influence portion.

The ground electrodes 153 and 159 are opposed to the wide portions 160*b* and 161*b*. Further, a ground electrode 141 (not shown) is provided on the undersurface of the first layer 152 so as to face the narrow portions 160*c* and 161*c*. Similarly, a ground electrode 142 is provided on the top surface of a protection layer 151*a* so as to face the narrow portions 160*c* and 161*c*. The ground electrodes 141 and 142 are connected to the ground electrodes 153 and 159 via inner vias. Therefore, as in Embodiments 1 and 2, Q of the narrow portions 160*c* and 161*c* is increased and the electric capacitance of the wide portions 160*b* and 161*b* and the ground electrodes 153 and 159 is increased. The ground electrodes 153 and 159 are not formed on portions opposed to the narrow portions 160*c* and 161*c*. This configuration is similar to those of Embodiments 1 and 2. The dielectric filter is 3.5 mm in length, 3.5 mm in width, and 0.4 mm in thickness.

Figure 15:
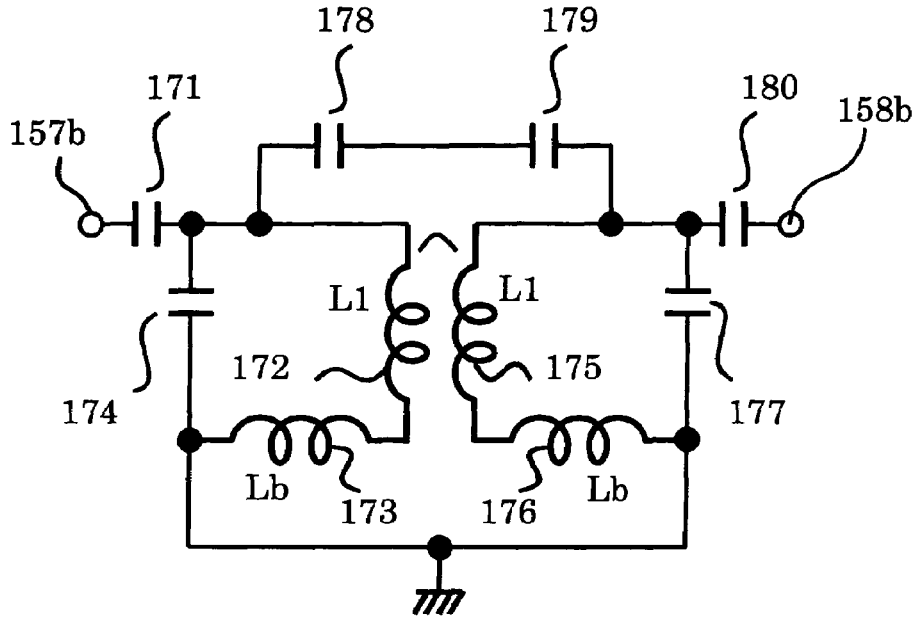
FIG. 15 is a replacement circuit diagram where the pattern of the dielectric filter is replaced with electric elements.

FIG. 15 is a replacement circuit diagram showing a dielectric filter where a pattern is replaced with electric elements. In FIG. 15, reference numeral 157*b* denotes the input/output terminal and reference numeral 171 denotes a capacitance formed between the input/output electrode 157*a* and the wide portion 160*b*. Reference numeral 172 denotes an inductance of the narrow portion 160*d* and reference numeral 173 denotes an inductance of the narrow portion 160*e*. Reference numeral 174 denotes a capacitance formed between the resonant element 160 and the ground electrodes 153 and 159 and the ground electrode 166.

Similarly, reference numeral 175 denotes an inductance of the narrow portion 161*d* and reference numeral 176 denotes an inductance of the narrow portion 161*e*. Reference numeral 177 denotes a capacitance formed between the resonant element 161 and the ground electrodes 153 and 159 and the ground electrode 166. Since the wide portions 160*b* and 161*b* are wide and short, the inductances thereof are negligible. In this case, the first portions 160*d* and 161*d* are equal in length. The second portions 160*e* and 161*e* are also equal in length. Therefore, the inductance 172 and the inductance 175 are equal to each other and the inductance 173 and the inductance 176 are equal to each other. The capacitance 174 and the capacitance 177 are also equal to each other.

Reference numeral 178 denotes a capacitance between the wide portion 160*b* and the capacitive electrode 164 and reference numeral 179 denotes a capacitance between the capacitive electrode 164 and the wide portion 161*b*. Reference numeral 180 denotes a capacitance formed between the input/output electrode 158*a* and the wide portion 161*b*. Reference numeral 158*b* denotes the input/output terminal connected to the capacitance 180.

In the present embodiment, the ground electrodes 159 and 142 and the ground electrodes 153 and 141 shield the top surface and undersurface of the dielectric filter at the ground, thereby reducing external influence. The ground electrodes are provided on the top surface and the undersurface of the dielectric filter, thereby increasing an electric capacitance between the ground electrodes and the resonator electrode 155 and contributing to miniaturization.

Figure 16:
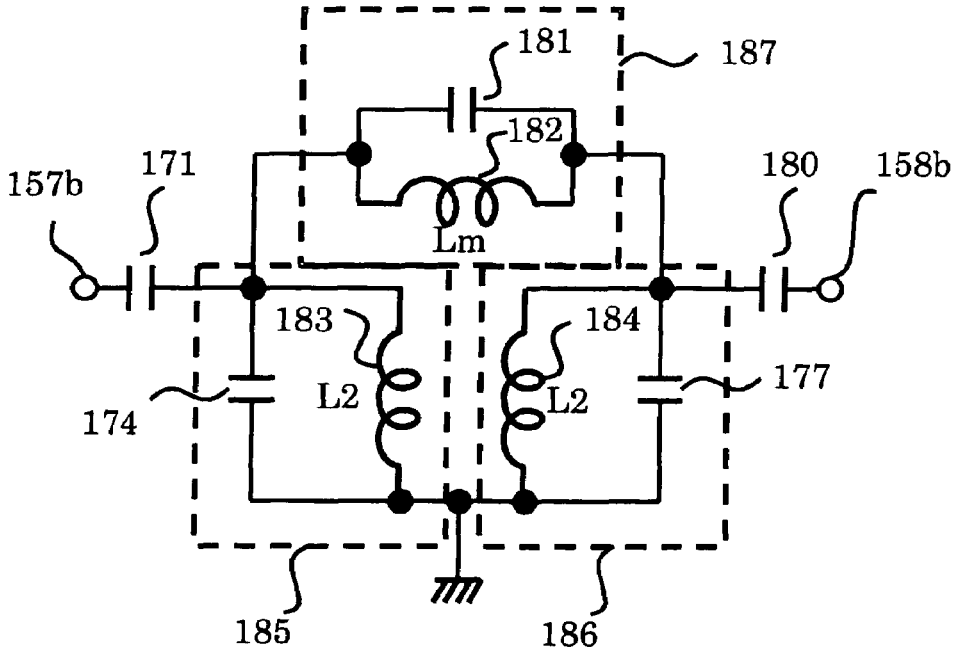
FIG. 16 is an equivalent circuit diagram of the replacement circuit diagram.

FIG. 16 is an equivalent circuit diagram of the replacement circuit diagram shown in FIG. 15. In FIG. 16, reference numeral 181 denotes a combined capacitance of the capacitance 178 and the capacitance 179 and reference numeral 182 denotes an inductance obtained by the electromagnetic coupling of the resonant elements 160 and 161. Reference numeral 183 denotes a combined inductance of the inductance 172 and the inductance 173 and reference numeral 184 denotes a combined inductance of the inductance 175 and the inductance 176.

To be specific, the dielectric filter is constituted of a parallel connection body 185 in which the inductance 183 and the capacitance 174 are connected in parallel, the parallel connection body 185 having one terminal connected to the ground and the other terminal connected to the input/output terminal 157*b* via the capacitance 171, a parallel connection body 186 in which the inductance 184 and the capacitance 177 are connected in parallel, the parallel connection body 186 having one terminal connected to the ground and the other terminal connected to the input/output terminal 158*b* via the capacitance 180, and a parallel connection body 187 which is connected between the other terminals of the parallel connection body 185 and the parallel connection body 186 and composed of the inductance 182 and the capacitance 181. The capacitance 181 and the inductance 182 constituting the parallel connection body 187 form a parallel resonant circuit to obtain a notch filter. A band-pass filter for removing a frequency designated by the notch filter has such a configuration.

In this case, the relationship of (Formula 1) is established where Lm represents the inductance 182, L1 represents the first portion 160*d* (or 161*d*), Lb represents a second portion 160*e* (or 161*e*), and K represents a coupling coefficient indicating inductive coupling.

$$Lm \approx (L1+Lb)^2/(K \times L1) \quad \text{(Formula 1)}$$

$$(K \ll 1)$$

(Formula 1) indicates that the inductance 182 is proportionate to the square of Lb (that is, the second portions 160*e* and 161*e* of the narrow portions 160*c* and 161*c*). In other words, even when a distance 167 between the first portions 160*d* and 161*d* corresponding to L1 is reduced and inductive coupling is increased, the inductance 182 can be made larger by increasing the second portions 160*e* and 161*e* corresponding to Lb. That is, the resonant elements 160 and 161 are bent at right angles to form the second portions 160*e* and 161*e* not electromagnetically coupled to each other, so that the inductance 182 can be changed almost independently from inductive coupling. In this way, it is possible to control the magnitude of the inductance and inductive coupling causing electromagnetic coupling, so that even when the distance 167 between the resonant elements 160 and 161 is reduced, loose coupling can be obtained. Therefore, it is possible to achieve a small narrow-band filter.

Further, the relationship of (Formula 2) is established where L2 represents the inductance 183, L1 represents the first portion 160*d* (or 161*d*), and Lb represents the second portion 160*e* (or 161*e*) as in (Formula 1)

$$L2 \approx L1+Lb \quad \text{(Formula 2)}$$

$$(K \ll 1)$$

The inductance 183 is represented as a sum of the first portion 160*d* (or 161*d*) and the second portion 160*e* (or 161*e*).

On the other hand, the dielectric filter has a passage center frequency proportionate to a factor of the square root of the product of the inductance 183 (or 184) and the capacitance 174 (or 177). In the present embodiment, by changing a ratio of the first portion 160*d* (or 161*d*) to the second portion 160*e* (or 161*e*), it appears that a coupling coefficient (a degree of inductive coupling) is changed while keeping the inductance 183. Conversely, the inductance 183 can vary without changing inductive coupling. Therefore, it is possible to achieve a small narrow-band filter without changing a signal pass characteristic. Moreover, a wide-band filter and a narrow-band filter can be designed more flexibly.

Figure 17:
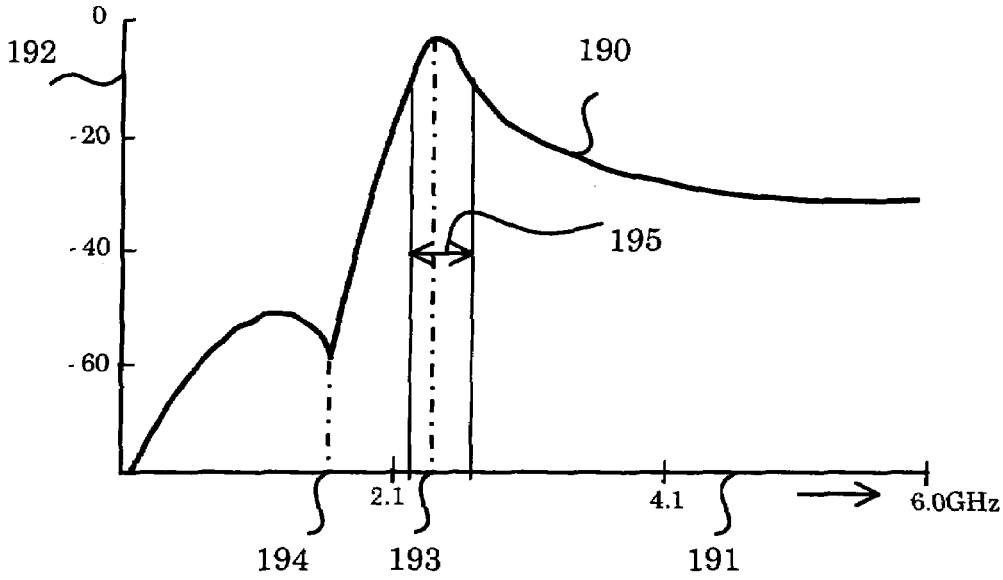
FIG. 17 is a signal pass characteristic diagram of the dielectric filter.

FIG. 17 is a signal pass characteristic diagram of the dielectric filter. Reference numeral 190 denotes a passage characteristic curve of a signal. A horizontal axis 191 represents a frequency (GHz) and a vertical axis 192 represents an attenuation (dB). On the passage characteristic curve 190, a center frequency 193 of the dielectric filter is proportionate to a factor of the square root of the product of the inductance 183 (or 184) and the capacitance 174 (or 177). The passage characteristic is determined by the magnitude of the inductance 182 obtained by the electromagnetic coupling of the inductance 183 and the inductance 184. Therefore, the present invention makes it possible to almost independently control the coupling coefficient K and the inductance 183 (or 184). Even when the distance 167 between the resonant elements 160 and 161 is reduced, a narrow-band filter can be obtained, contributing to miniaturization.

Reference numeral 194 denotes a notch frequency proportionate to a factor of the square root of the product of the inductance 182 and the capacitance 181.

Embodiment 4

Figure 18:
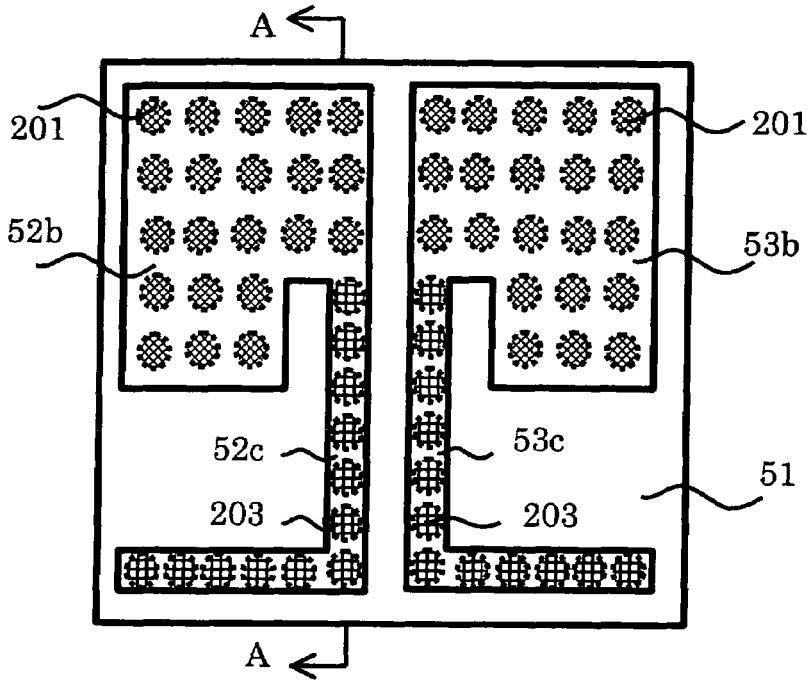
FIG. 18 is a perspective plan view showing a dielectric filter according to Embodiment 4 of the present invention.
Figure 19:
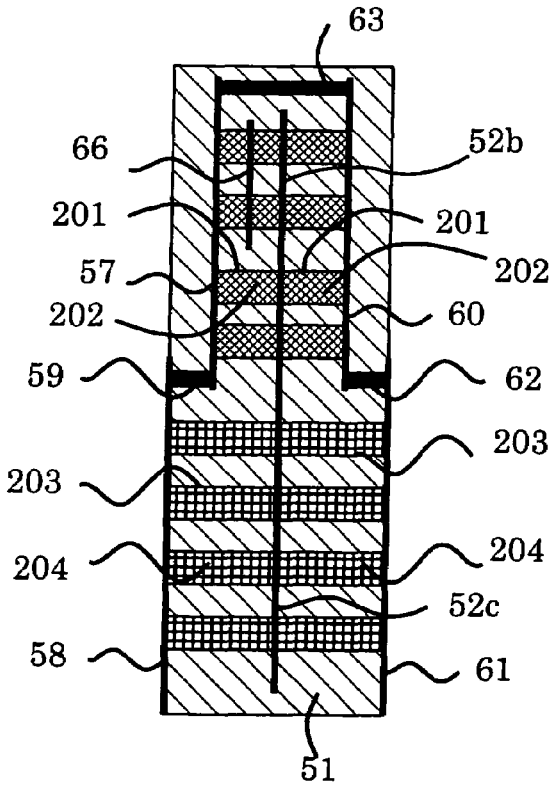
FIG. 19 is a sectional view of the dielectric filter.

FIG. 18 is a plan view showing a dielectric filter according to Embodiment 4. FIG. 19 is a sectional view taken along line A-A of FIG. 18. The same constituent elements as Embodiment 1 will be indicated by the same reference numerals and the explanation thereof is simplified.

Embodiment 4 is different from Embodiment 1 in that a permittivity between wide portions 52*b* and 53*b* and first upper and lower ground electrodes 57 and 60 is increased and a permittivity between narrow portions 52*c* and 53*c* and second upper and lower ground electrodes 58 and 61 is reduced.

To be specific, as shown in FIGS. 18 and 19, a plurality of holes 201 are provided at almost regular intervals between the wide portions 52*b* and 53*b* and the first upper and lower ground electrodes 57 and 60. The holes 201 are filled with a dielectric 202 having a higher permittivity than a dielectric substrate 51. It is significant that the holes 201 are closely arranged such that an excessive stress is not applied to the dielectric substrate 51 due to a difference in coefficient of thermal expansion between the dielectric 202 and the dielectric substrate 51. The holes 201 may be placed out of the wide portions 52*b* and 53*b*.

With this configuration, a permittivity relative to the ground electrodes 57 and 60 corresponding to the wide portions 52*b* and 53*b* becomes higher than that of the dielectric substrate 51, thereby increasing an electric capacitance formed between the wide portions 52*b* and 53*b* and the ground electrodes 57 and 60. That is, it is possible to reduce the wide portions 52*b* and 53*b* with the same electric capacitance, thereby miniaturizing the dielectric filter.

A plurality of holes 203 are provided at almost regular intervals between narrow portions 52*c* and 53*c* and the second upper and lower ground electrodes 58 and 61. The holes 203 are filled with a dielectric 204 having a lower permittivity than the dielectric substrate 51. It is significant that the holes 203 are closely arranged such that an excessive stress is not applied to the dielectric substrate 51 due to a difference in coefficient of thermal expansion between the dielectric 204 and the dielectric substrate 51. The holes 203 may be placed out of the wide portions 52*c* and 53*c*. The hole 203 is equal in diameter to the hole 201.

With this configuration, a permittivity between the ground electrodes 58 and 61 corresponding to the narrow portions 52*c* and 53*c* is reduced, thereby reducing the conductor loss of the narrow portions 52*c* and 53*c*. That is, it is possible to increase Q of inductances forming the dielectric filter.

By filling the holes 201 with a ferroelectric, it is possible to achieve an active filter in which control oh a DC bias changes a permittivity and a filter characteristic.

Embodiment 5

Figure 20:
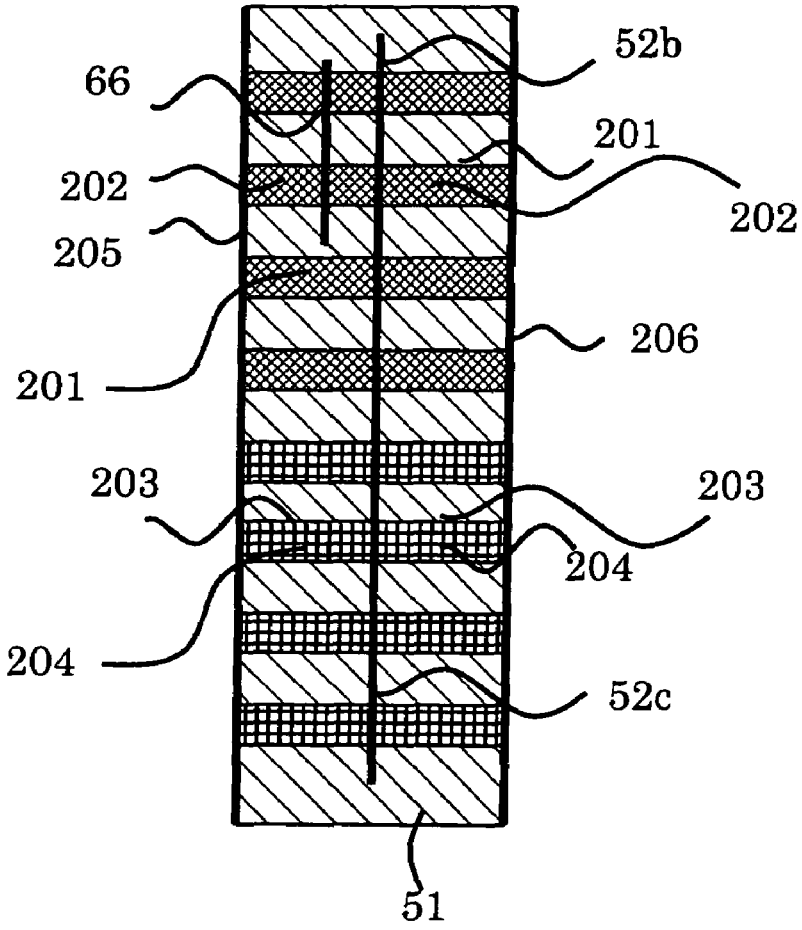
FIG. 20 is a sectional view showing a dielectric filter according to Embodiment 5 of the present invention.
Figure 21:
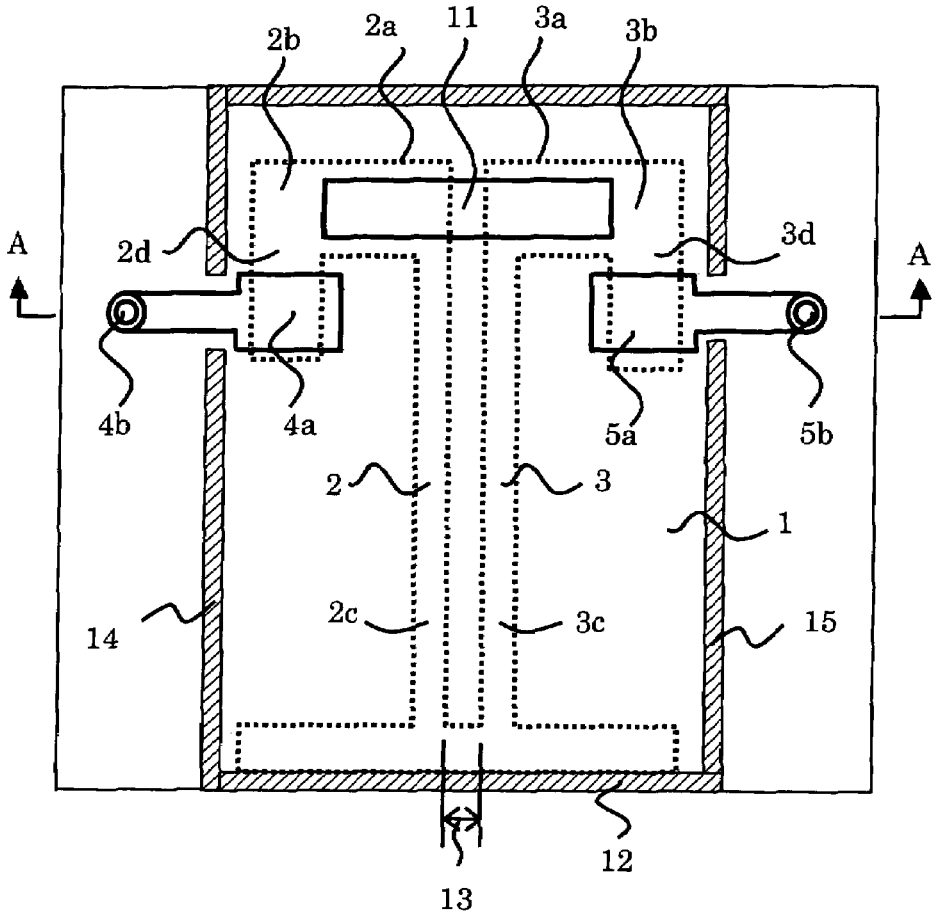
FIG. 21 PRIOR ART
FIG. 21 is a perspective plan view showing a conventional dielectric filter.
Figure 22:
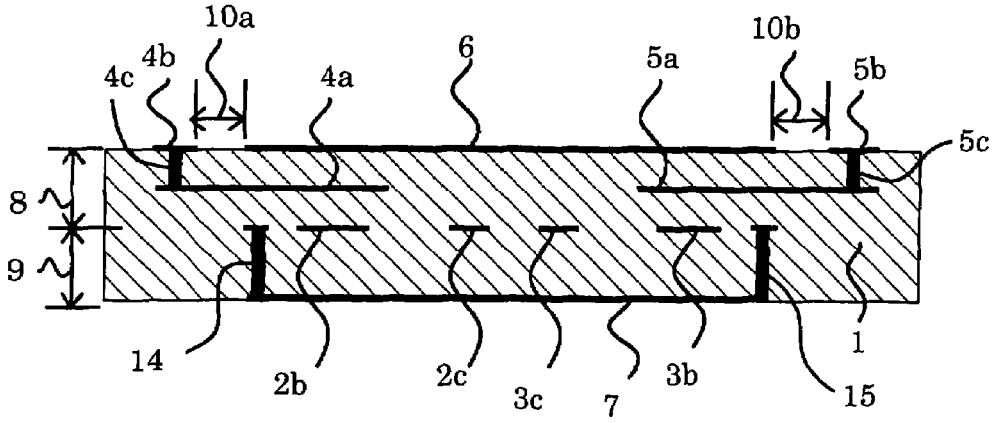
FIG. 22 PRIOR ART
FIG. 22 is a sectional view of the dielectric filter.
Figure 23:
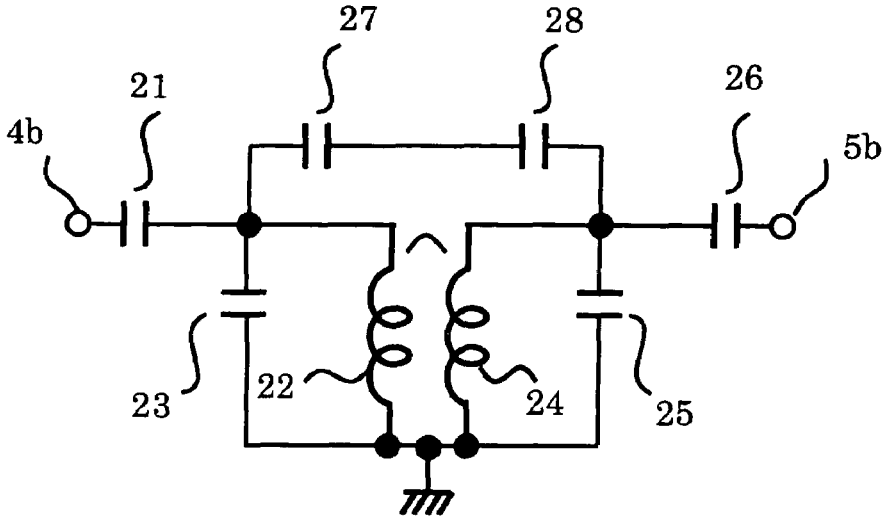
FIG. 23 PRIOR ART
FIG. 23 is a replacement circuit diagram where the pattern of the dielectric filter is replaced with electric elements.
Figure 24:
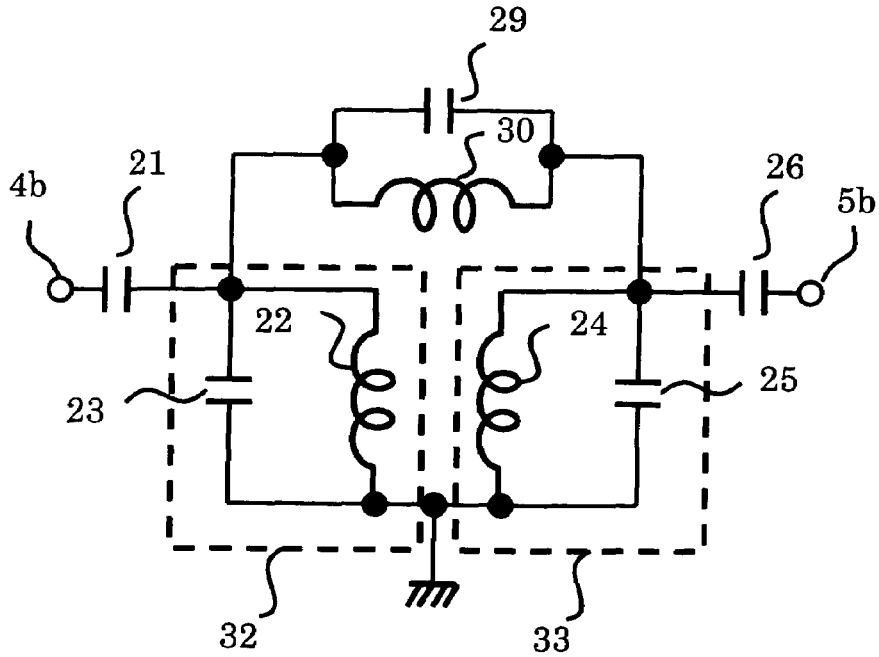
FIG. 24 PRIOR ART
FIG. 24 is an equivalent circuit diagram of the replacement circuit diagram.
Figure 25:
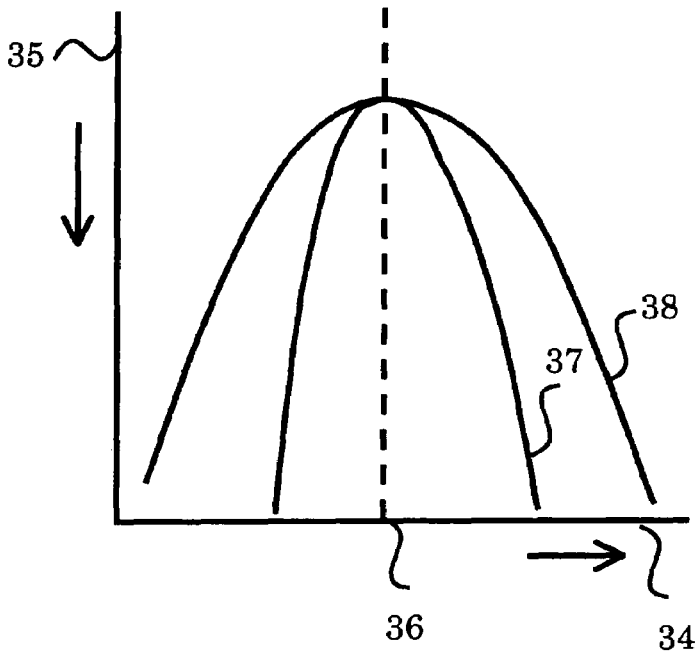
F I G. 2 5 PRIOR ART
FIG. 25 is a signal pass characteristic diagram of the dielectric filter.

FIG. 20 is a sectional view showing a dielectric filter according to Embodiment 5. The same constituent elements as Embodiment 1 will be indicated by the same reference numerals and the explanation thereof is simplified.

Embodiment 5 is similar in concept to Embodiment 4. Embodiment 5 is different from Embodiment 4 in that ground electrodes 205 and 206 are integrally provided. To be specific, as shown in FIG. 20, a plurality of holes 201 are provided at almost regular intervals between wide portions 52*b* and 53*b* and the ground electrodes 205 and 206. The holes 201 are filled with a dielectric 202 having a higher permittivity than a dielectric substrate 51. It is significant that the holes 201 are closely arranged such that an excessive stress is not applied to the dielectric substrate 51 due to a difference in coefficient of thermal expansion between the dielectric 202 and the dielectric substrate 51. The holes 201 may be placed out of the wide portions 52*b* and 53*b*.

With this configuration, a permittivity relative to the ground electrodes 205 and 206 corresponding to the wide portions 52*b* and 53*b* becomes higher than that of the dielectric substrate 51, thereby increasing an electric capacitance between the wide portions 52*b* and 53*b* and the ground electrodes 205 and 206. That is, it is possible to reduce the wide portions 52*b* and 53*b* with the same electric capacitance, thereby miniaturizing the dielectric filter. The integrated ground electrodes 205 and 206 facilitate fabrication.

A plurality of holes 203 are provided at almost regular intervals between narrow portions 52*c* and 53*c* and the ground electrodes 205 and 206. The holes 203 are filled with a dielectric 204 having a lower permittivity than the dielectric substrate 51. It is significant that the holes 203 are closely arranged such that an excessive stress is not applied to the dielectric substrate 51 due to a difference in coefficient of thermal expansion between the dielectric 204 and the dielectric substrate 51. The holes 203 may be placed out of the narrow portions 52*c* and 53*c*. The hole 203 is equal in diameter to the hole 201.

With this configuration, a permittivity relative to the ground electrodes 205 and 206 corresponding to the narrow portions 52*c* and 53*c* is reduced, and thus the conductor loss of the narrow portions 52*c* and 53*c* can be reduced. That is, it is possible to increase Q of inductances forming the dielectric filter, thereby reducing an insertion loss.

What is claimed is:

1. A dielectric filter comprising a dielectric multilayered substrate having an upper surface and a lower surface when the filter is in a horizontal position, comprising:

first and second resonant elements in an inner layer of the substrate, each comprising:

an open end and a grounded end;

a wide portion at the open end for electromagnetically coupling the first and second resonant elements with each other, and a narrow portion at the grounded end;

first and second input/output electrodes located entirely above the wide portions;

a first upper ground electrode in a layer above the input/output electrodes;

said first upper ground electrode located above said wide portions of the resonant elements, and not located above said narrow portions of the resonant elements, and being above substantially all of the surface area of said wide portions;

a second upper ground electrode in a layer above said first upper ground electrode, said second upper ground electrode located above substantially only said narrow portions of the resonant elements, a first lower ground electrode in a layer below said first and second resonant elements, said first lower ground electrode located below said wide portions of the resonant elements and not located below said narrow portions of the resonant elements, and being below substantially all of the surface area of said wide portions; and a second lower ground electrode in a layer below said first lower ground electrode and located below substantially only said narrow portions of the resonant elements.

2. The dielectric filter according to claim 1, wherein a via connects said input/output electrodes located at a layer below said first upper ground electrode to input/output terminals at a top layer of the multilayer substrate without contacting said first upper ground electrode.

3. The dielectric filter according to claim 2, wherein the first upper and lower ground electrodes are connected to one another via inner vias and the second upper and lower ground electrodes are connected to the first upper and lower ground electrodes, respectively, via inner vias.

4. The dielectric filter according to claim 1, further comprising a capacitive electrode for electromagnetic coupling in each of an upper layer and a lower layer corresponding to the wide portions, the capacitive electrode being connected via an inner via to the wide portion corresponding to the capacitive electrode.

5. The dielectric filter according to claim 1, further comprising an electronic circuit formed either in a layer above the first upper ground electrode or a layer below the first lower ground electrode.

6. The dielectric filter according to claim 1, wherein the narrow portion of each of the resonant elements comprises a first part connected to the wide portion and arranged in parallel with the narrow portion of the other resonant element and a second part between the first part and ground, wherein the second part is perpendicular to the first part and arranged in an opposite direction along a straight line from the second part of the narrow portion of the other resonant element.

7. The dielectric filter according to claim 1, further comprising a ground electrode facing the wide portions between the input/output electrodes.

8. The dielectric filter according to claim 1, further comprising a plurality of holes provided at almost regular intervals on the first upper ground electrode and first lower ground electrodes corresponding to the wide portions, the holes being filled with a dielectric having a higher permittivity than the dielectric substrate.

9. The dielectric filter according to claim 1, further comprising a plurality of holes provided at almost regular intervals on the second upper ground electrode and second lower ground electrode corresponding to the narrow portions, the holes being filled with a dielectric having a lower permittivity than the dielectric substrate.

10. The dielectric filter according to claim 9, further comprising a plurality of holes provided at almost regular intervals on the first upper ground electrode and first lower ground electrodes corresponding to the wide portions, the holes being filled with a dielectric having a higher permittivity than the dielectric substrate.

11. The dielectric filter according to claim 8, wherein the plurality of holes are filled with a ferroelectric, the holes being formed at almost regular intervals between the first upper ground electrode and first lower ground electrode corresponding to the wide portions.

* * * * *